United States Patent [19]

Chew et al.

[11] 4,433,355

[45] Feb. 21, 1984

[54] ELECTRONIC LOCKS FOR DOORS

[75] Inventors: Ivan Chew, Wolverhampton; John Verhaeg, Kingswinford, both of England

[73] Assignee: Yale Security Products Ltd., Willenhall, England

[21] Appl. No.: 320,972

[22] PCT Filed: Feb. 27, 1981

[86] PCT No.: PCT/GB81/00029

§ 371 Date: Nov. 3, 1981

§ 102(e) Date: Nov. 3, 1981

[87] PCT Pub. No.: WO81/02603

PCT Pub. Date: Sep. 17, 1981

[30] Foreign Application Priority Data

Mar. 4, 1980 [GB] United Kingdom ..... 8007325

[51] Int. Cl.[3] ..... H01H 47/00

[52] U.S. Cl. ..... 361/172; 70/277

[58] Field of Search ..... 361/172, 171; 70/277, 70/278

[56] References Cited

U.S. PATENT DOCUMENTS 4,038,846 8/1977 Klann ..... 361/172 X

FOREIGN PATENT DOCUMENTS 2324392 12/1974 Fed. Rep. of Germany ..... 361/172

*Primary Examiner*—Reinhard J. Eisenzopf

*Attorney, Agent, or Firm*—Sughrue, Mion, Zinn, Macpeak and Seas

[57] ABSTRACT

An electronic lock for a door includes a built-in generator (20) for generating electrical energy for operating an electronic code recognition circuit and energizing a lock-release solenoid when appropriate. The generator (20) is linked to the door handle spindle (31) via a resilient mechanical energy storage device (24) which is "wound up" during the initial part of turning of the handle and tripped at a predetermined point to release stored energy into the generator (20).

13 Claims, 11 Drawing Figures

ELECTRONIC LOCKS FOR DOORS

TECHNICAL FIELD

This invention relates to electronic locks for doors.

BACKGROUND ART

It has already been proposed to substitute for conventional mechanical door locks, systems of various sorts in which a "key " is recognized by an electronic circuit which enables the locking bolt to be withdrawn. Since electronic circuits require power previously proposed electronic locks have required a battery to be incorporated in the lock housing, the provision of mains wiring to a lock being undesirable. If, however, a householder fails to change his lock battery it will be impossible to open the door from the outside and the householder may have to resort to breaking in to his own property.

The object of the present invention is to provide an electronic lock in which no battery or mains supply is required.

DISCLOSURE OF INVENTION

In its broadest aspect the invention resides in an electronic lock comprising the combination of an operating member for displacing a locking element, an electronic circuit controlling the operation of the lock and electrical generator means mechanically connected to the operating member so as to generate electrical power for the lock and its electronic circuit when the operating member is moved.

More particularly, an electronic lock in accordance with the invention comprises a body, a lock operating member movably mounted on said body, a lock bolt movably mounted on said body, electrically operated means for enabling movement of the operating member to cause displacement of the bolt, an electronic circuit controlling said electrically operated means and responsive to a coded signal derived from a key element so as to enable movement of the bolt only when a specific coded signal or one of a small number of specific coded signals is received and electrical generator means mechanically connected to the operating member so as to generate electrical power for said electrically operated means and said electronic circuit when said operating member is moved.

Preferably the generator means includes resilient means drivingly connected to the operating member so as to store energy during initial movement of the operating member release means operably by the operating member to release said resilient means and connecting means connecting the resilient means to an electrical generator so that said resilient means when released drives the generator, continuing movement of the operating member displacing said bolt if the said specific coded signal is received.

BEST MODE OF CARRYING OUT THE INVENTION

Figure 1:
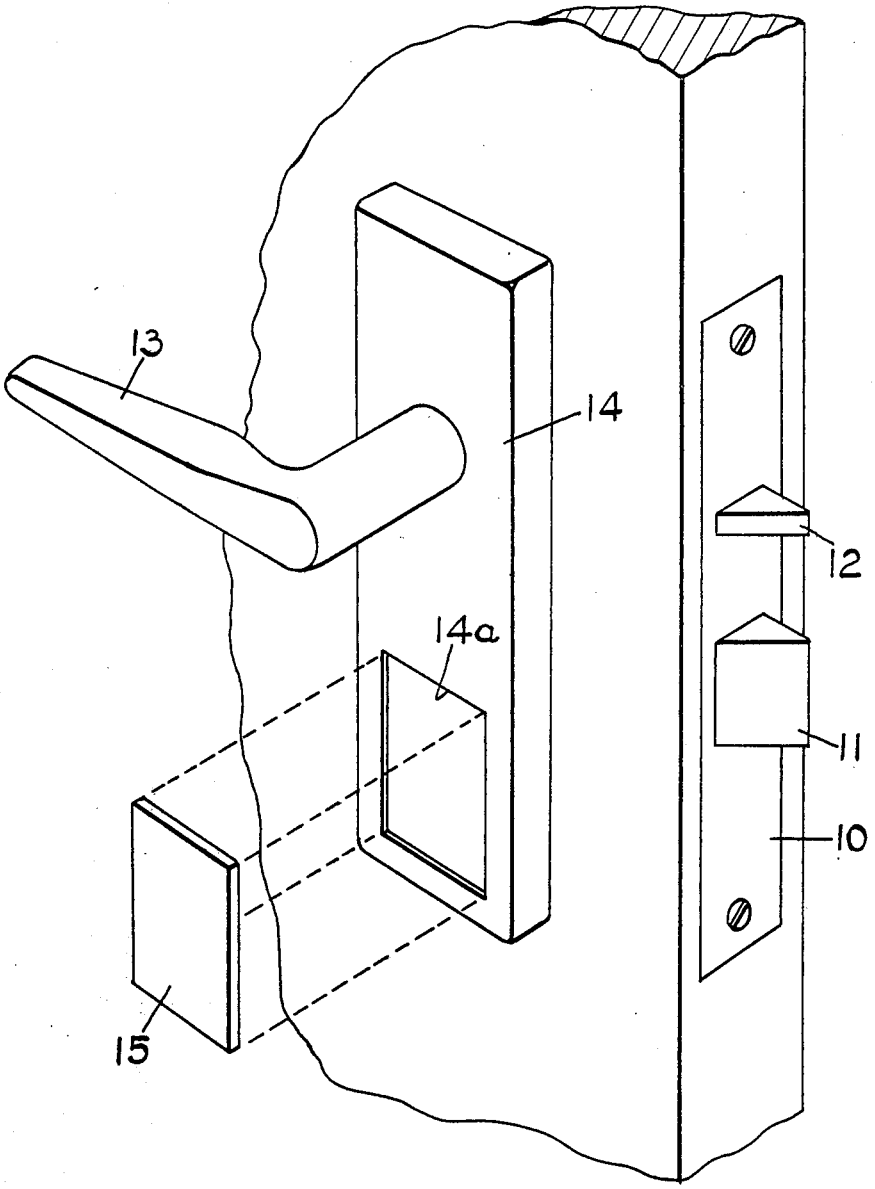
FIG. 1 is a perspective view of one example of a lock in accordance with the present invention in position on a door.

Referring firstly to FIG. 1 the lock includes a face plate 10 intended to be attached to the edge of a door in which the lock is used. Projecting from this face plate is a locking element 11 in the form of a bolt, and an auxiliary bolt 12, the purpose of which will be described hereinafter. Movement of the locking bolt 11 is achieved by means of an operating member in the form of a lever handle 13 coupled to the locking mechanism (see FIGS. 4 to 6) by a square spindle (not shown in FIG. 1). A base plate 14 on which the handle 13 is carried, is formed with a rectangular recess 14*a* which is shaped to receive a rectangular magnetic key card 15.

Figure 2:
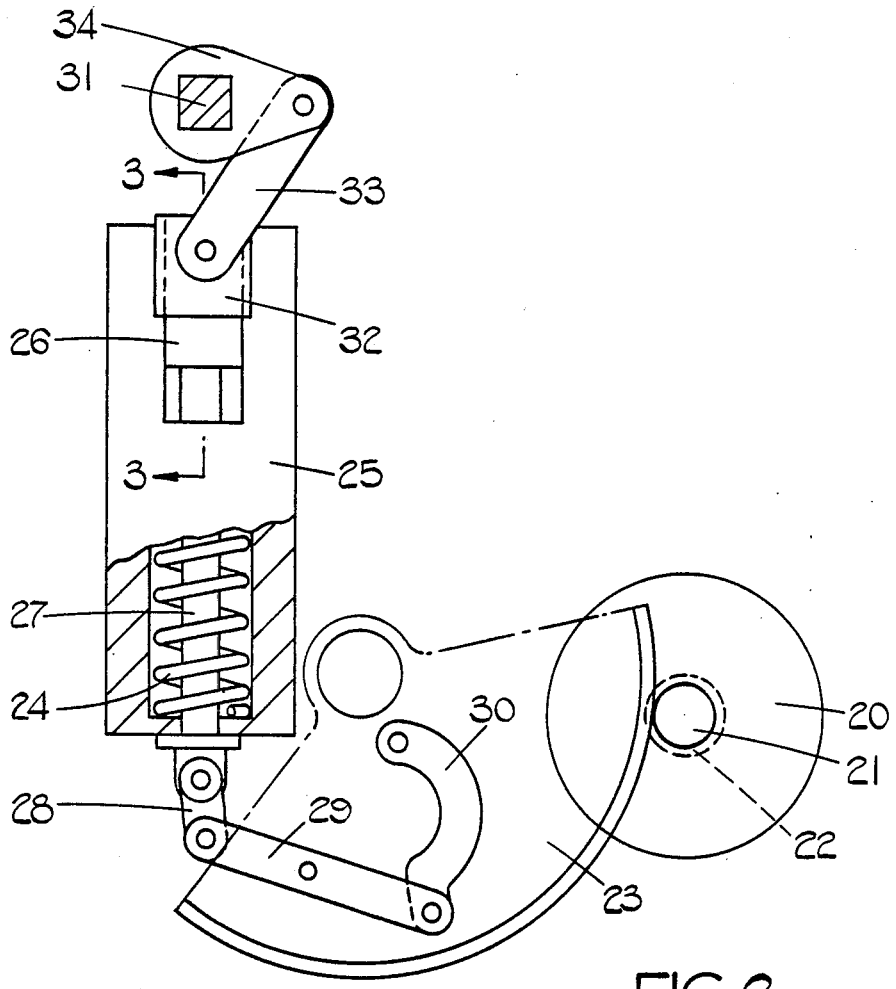
FIG. 2 is a part-sectional view of a generator and drive mechanism therefor incorporated in the lock of FIG. 1.
Figure 3:
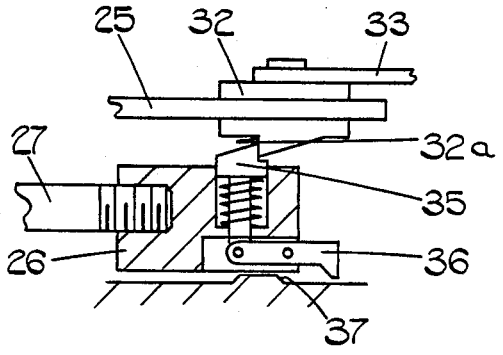
FIG. 3 is a fragmentary section on line 3—3 in FIG. 2, FIGS. 4 to 6 are part-sectional views of a locking mechanism incorporated in the lock of FIG. 1 in different states.

Turning now to FIGS. 2 and 3, there is shown a generator 20 in the form of a permanent magnet alternator which is used to provide electrical power for operating the lock and its electronic circuitry. The alternator 20 has a drive shaft 21 on which there is a pinion 22 connected to shaft 21 by a one-way clutch (not shown in detail). The pinion 22 meshes a gear segment 23 pivotally mounted on the lock casing and connected by a linkage to a spring drive mechanism operated by the handle 13 of FIG. 1.

The spring drive mechanism includes a main energy storage spring 24 which is contained within a hollow guide 25 on the lock casing. A plunger member 26 is slidably mounted on the guide 25 and the spring 24 is compressed between this member 26 and the guide 25. A rod 27 attached to the plunger 26 projects from the guide 25 and is connected by a first link 28 to one end of a lever 29 pivotally mounted intermediate its ends on the lock casing. The other end of lever 29 is connected by a second link 30 to the gear segment 23 so that movement of the plunger 26 along the guide 25 causes rotation of the gear segment 23 and thereby of the pinion 22.

The plunger 26 is provided with a driving connection to the square spindle 31 already referred to. This connection includes a slide member 32 slidably mounted on the guide 25 and connected by a link 33 to an arm 34 on the square spindle 31. The slide 32 has a detent 32*a*, thereon, which engages with a spring-loaded detent 35 mounted on the plunger 26. This detent 35 is connected to a trip-lever 36 which coacts with a projection 37 on the lock case.

When the handle 13 is turned, the arm 34 turns clockwise as viewed in FIG. 2 and displaces the slide 32 downwardly. The plunger 26 is carried downwardly with the slide 32 compressing the spring 24 and causing the gear segment 23 to turn in an anti-clockwise direction. The unidirectional clutch associated with the pinion 22 overruns in this condition so that the alternator shaft 21 is not driven. When the handle 13 has been turned through about 60°, the trip-lever 36 contacts the projection 37 and displaces the detent 35 out of engagement with the detent 35*a*. The spring 24 now operates as a motor which drives the plunger 26 back upwardly, turning the gear segment 23 in clockwise direction and thereby driving the alternator.

The arrangement described in which mechanical energy is stored and then released to drive the alternator, ensures that the alternator is always driven consistently, irrespective of the speed at which the handle is turned by the user. The energy for driving the alternator is collected over a relatively large angle of rotation of the handle so that the torque requirement can be kept reasonably low. The stored energy is released relatively quickly.

Figure 4:
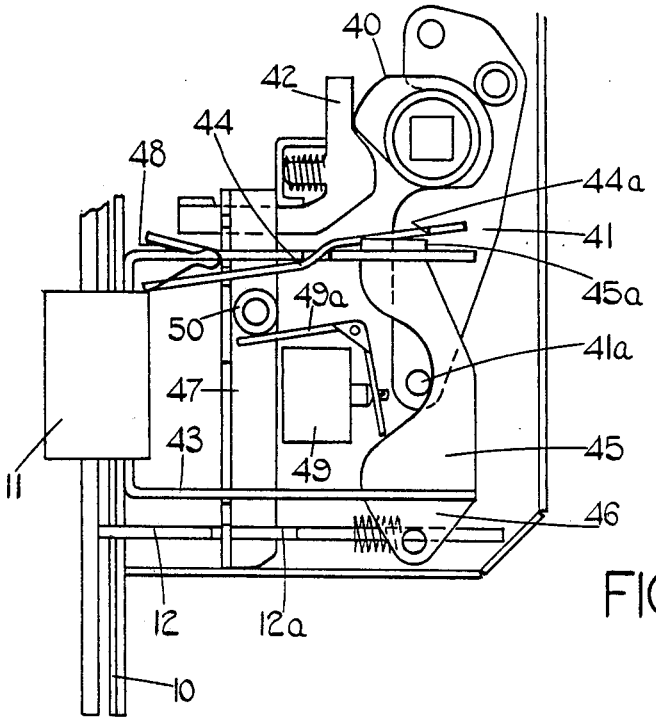
Figure 5:
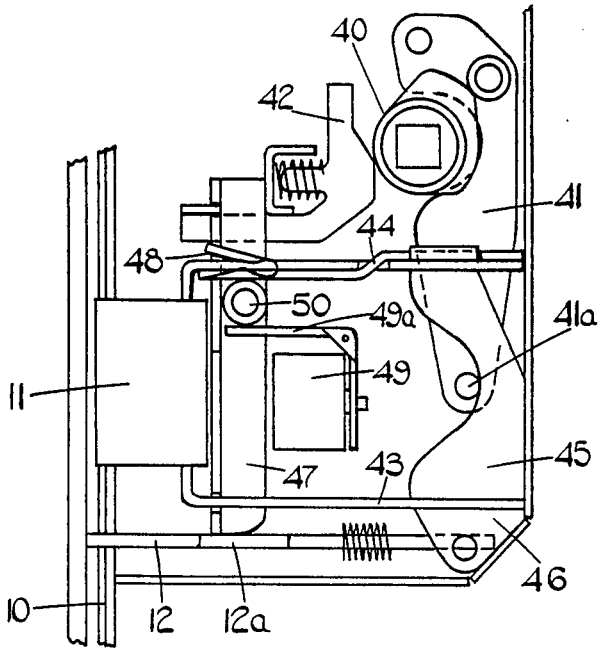
Figure 6:
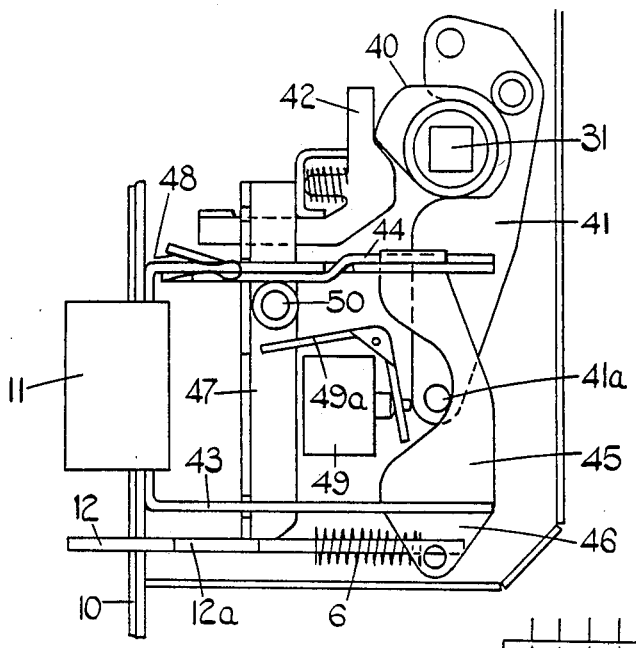

Turning now to FIGS. 4 to 6, the locking mechanism includes a cam 40 driven by the square spindle 31. This cam 40 has two functions; firstly to turn a lever 41 pivotally mounted on the lock case and providing one part of a drive connection between the spindle 31 and the main bolt 11, and secondly to displace a catch slide 42.

The main bolt 11 is secured to a U-shaped member 43, on one limb of which a plate 44 is captive. This plate 44 coacts with an arm 45 pivotally mounted on a bracket 46 on the other limb of the U-shaped member 43. The plate 44 and the arm 45 have interengageable detents 44*a*, 45*a* thereon which are disengaged from one another in the locked condition shown in FIG. 4, but interengaged in the unlocked condition shown in FIGS. 5 and 6. A peg 41*a* on the lever 41 is engageable with the arm 45, so that, in the condition shown in FIG. 5, turning of the spindle 31, has resulted in the lever 41 turning anti-clockwise so that peg 41*a* drives the lever 45, the plate 44, the U-shaped member 43 and the bolt 11 as an assembly to the right. In the locked condition shown in FIG. 4 turning of spindle 31 turns the lever 41, but since detents 44*a* and 45*a* are disengaged arm 45 can turn freely in a clockwise direction and no movement is imparted to the plate 44 or the U-shaped member 43 which carries the main bolt 11.

The position of the plate 44 is determined by the position of a vertically slidable latch piece 47, a spring 48 acting between the U-shaped member 43 and the plate 44 urging the plate 44 to the position shown in FIG. 4. The latch piece 47 is normally urged by a spring (not shown) to the position shown in FIG. 4, but can be lifted to the raised position it occupies in FIG. 5 by the action of a solenoid 49 which operates a pivoted L-shaped armature 49*a* which contacts a follower 50 on the latch piece 47. The follower 50 is engageable with the underside of the plate 44. The latch piece 47 has a detent portion which engages the catch slide 42 when the latch piece 47 is raised and the handle 13 is turned far enough for cam 40 to permit sliding movement of catch slide 42 to the right as viewed in FIG. 5. This ensures that the latch piece 47, once raised, remains raised for as long as the handle is kept in its turned position. The lower end of the latch piece 47 also coacts with the auxiliary bolt 12, so that as viewed in FIG. 6 the latch piece 47 is maintained in its raised position by the auxiliary bolt 12 when the latter is extended by its spring-loading when the door is open. When the door is closed, as in FIGS. 4 and 5, the auxiliary bolt is urged horizontally into the lock casing to align a slot 12*a* in the bolt 12 with the vertical latch piece 47.

Thus, when the handle is turned to open the door, the solenoid 49 is not energised by the alternator when the latter operates, latch piece 47 is not raised and no motion is transmitted to the U-shaped member 43 and the main bolt 11—i.e. the door remains locked. If, on the other hand, the solenoid is energised latch piece 47 is raised and is latched in its raised position by the catch slide 42, so that continued turning of the handle 13 withdraws the bolt, permitting opening of the door. Release of the handle with the door open causes catch slide 42 to move out of engagement with latch piece 47, the latter then being held raised by the auxiliary bolt 12. On closing of the door, auxiliary bolt 12 is driven back into the lock casing, causing latch piece 47 to drop back to the position shown in FIG. 4 so that the door is relocked.

It will be appreciated that various springs required for the proper operation of the mechanism of FIGS. 4 to 6 have been omitted for the sake of clarity. These springs consist of a spring acting on bolt 11 or member 43 to urge these to the left as viewed in FIGS. 4 to 6, a spring acting downwardly on the latch piece 47, a torsion spring acting on lever 41 and urging it clockwise, and a torsion spring acting between brackets 46 and arm 45 urging the latter counter-clockwise.

Figure 7:
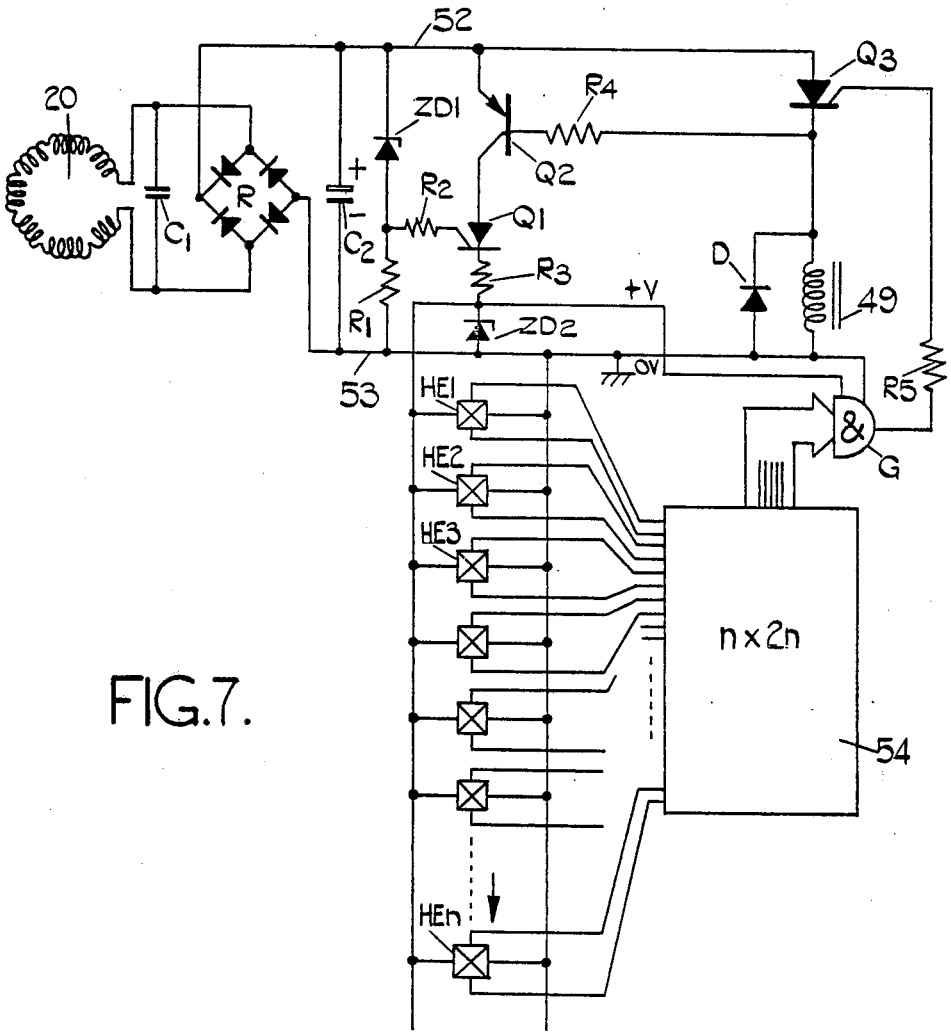
FIG. 7 is a circuit diagram of an electronic circuit forming part of the lock.

Turning now to FIG. 7, one example of the electronic circuit which controls the energisation of the solenoid 49 by the alternator 20 is shown. The alternator stator winding 20 is connected to the input terminals of a bridge rectifier R, the output terminals of which are connected to a positive supply rail 52 and a negative supply rail 53. A capacitor $C_1$ is connected across the alternator stator winding. A storage capacitor $C_2$ is connected between the rails 52, 53. A zener diode $ZD_1$ has its cathode connected to the rail 52 and its anode connected by a resistor $R_1$ to the rail 53. A resistor $R_2$ connects the anode of zener diode $ZD_1$ to the gate of a thyristor $Q_1$, the anode of which is connected to the collector of a pnp transistor $Q_2$. The emitter of the transistor $Q_2$ is connected to the rail 52 and its base is connected by a resistor $R_4$ and the solenoid winding 49 in series to the rail 53. The cathode of the thyristor $Q_1$ is connected by a resistor $R_3$ to the cathode of a second zener diode $ZD_2$ which has its anode connected to the rail 53. Another thyristor $Q_3$ has its anode connected to the rail 52 and its cathode connected by the winding 49 to the rail 53, a diode D being connected across the winding 49 to protect the thyristor $Q_3$ and the transistor $Q_2$ from the effects of cessation of current flow in the winding 49.

Figure 9:
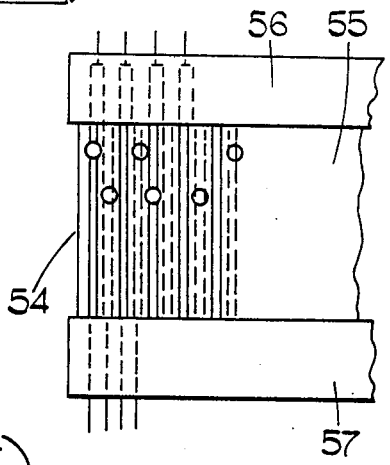
FIG. 9 shows a matrix member forming a part of the electronic circuit.

The gate of thyristor $Q_3$ is connected by a resistor $R_5$ to the output terminal of an AND gate G which has a plurality of inputs from a matrix connector device 54 which is unique for each different lock. As shown in FIG. 9 the matrix connector device may conveniently be in the form of a piece of double-sided printed circuit board 55 between two edge connectors 56, 57. The board 55 has straight parallel conductor tracks on both sides extending from one edge to the other. For example, for a sixteen-channel system the board 55 has sixteen tracks on each side, with the tracks on one side offset from those on the other side. In FIG. 9 the tracks on one side are shown in full lines and those on the other side in broken lines. The edge connector 56 has adjacent contacts connected together in pairs so that each pair contacts one track on each side of the board, but shares a common output terminal connected to an input of the gate G. In the 16 channel system there are sixteen such outputs. The connector 57 has 32 separate input terminals. To distinguish the boards 55 of different locks from one another a pattern of holes is drilled in the board 55 to break one track of each pair of tracks. The arrangement of the tracks in offset relationship on opposite sides of the board enables each track to be broken in this way without disturbing adjacent tracks. The drilled holes may be arranged on any of several different lines along the board to avoid too much weakening of the board along any particular line.

The input terminals of the connector 57 are connected to the output terminals of a plurality of integrated hall-effect devices $HE_1$, $HE_2$ . . . $HE_n$ which have input terminals connected to the anode of zener diode $ZD_2$ and to the rail 53. Each integrated hall-effect device is of known form such that it produces a logic-level signal at one output terminal if a magnetic south pole is close to the device when power is applied to the input terminals, or a logic-level signal at the other output terminal if a magnetic north pole is close to the device, when power is applied.

Figure 8:
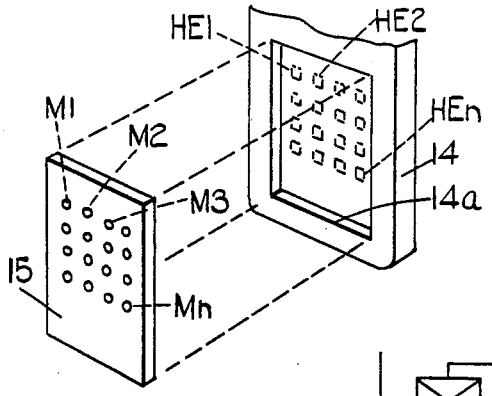
FIG. 8 is a diagrammatic perspective view of a key reader forming part of the lock together with an associated key.

As shown in FIG. 8 the integrated hall-effect devices are incorporated in the base of the recess 14*a* in the plate 14. In the example shown the sixteen devices are arranged in a square array. The key card 15 incorporates magnets $M_1$, $M_2$ . . . $M_n$ which may be printed or otherwise formed to provide either north or south poles on the face of the card which is intended to be adjacent the hall-effect devices when the card 15 is laid in the recess 14*a* the magnets are arranged in the same square array as the devices $HE_1$ to $HE_n$.

In use, when the alternator 20 is driven a voltage appears between rails 52 and 53 and energy is stored in capacitor $C_2$. When the voltage between rails 52 and 53 rises high enough to break down zener diode $ZD_1$, thyristor $Q_1$ is fired, and since transistor $Q_2$ is biased on at this stage by base current through the winding 49 (of insufficient magnitude to open the lock) current flows through resistor $R_3$ and zener diode $ZD_2$, establishing a zener-stabilized power supply for the integrated hall-effect devices and the gate G. If the key 15 corresponds to the board 55 the correct output terminals of the devices $HE_1$ to $HE_n$ will be connected by the board 55 to the inputs of the gate G, which will produce an output which fires thyristor $Q_3$. This results in energisation of the solenoid 49 to allow opening of the door and also causes transistor $Q_2$ to turn off, thereby cutting off the power supply to the hall-effect devices and the gate G, and saving as much as possible of the energy stored in the capacitor $C_2$ for energising the solenoid 49.

Figure 10:
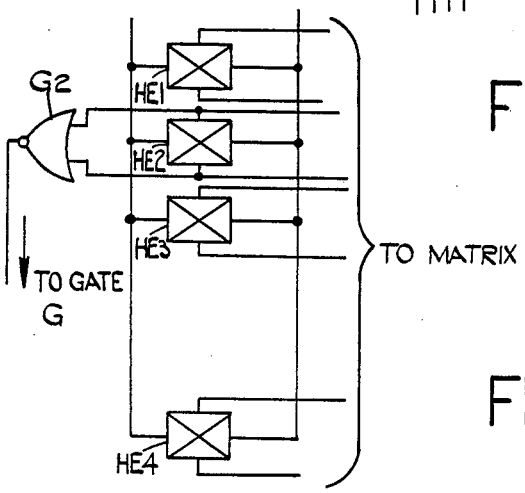
FIG. 10 is a circuit diagram showing a modification to FIG. 7.

In the modification shown in FIG. 10, one of the integrated hall-effect devices ($HE_2$) has a NOR gate $G_2$ connected to both of its output terminals, the output of this NOR being connected to appropriate input of the gate G instead of the corresponding output terminal of the connector 56 (or as well as the latter output terminal provided both of the associated tracks of the board 55 are interrupted). With this modification the key card will only be recognised if there is no magnet at the key array position corresponding to device $HE_2$ in the hall-effect device array. It will immediately be appreciated that the use of a gate $G_2$ at one or more positions in the array increases the number of combinations available from $2^n$ to $3^n-1$ i.e., from 65,536 to 43,046,720 in the case of a sixteen channel system. Various other logic alternatives can also be employed to allow multi-level master keying operation.

Figure 11:
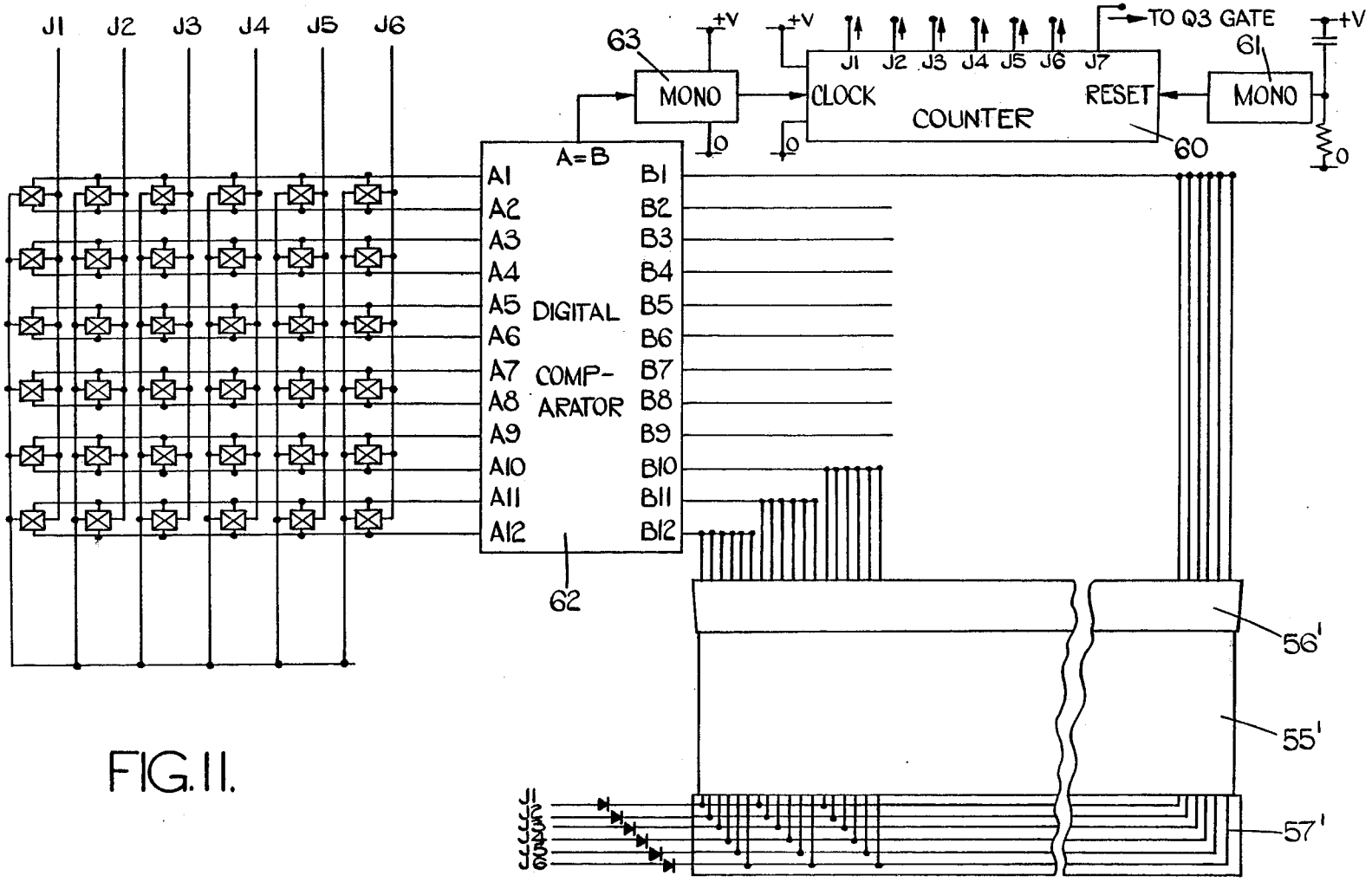
FIG. 11 is a diagrammatic representation of a more complex electronic circuit providing multiplex operation.

Turning finally to the circuit shown diagrammatically in FIG. 11 a multiplex operation system is envisaged enabling a still greater number of combinations to be employed, in this case a 6×6 matrix of hall-effect devices being utilized. The multiplex operation is controlled by a counter 60 shown as a seven counter of the type in which only one stage output is highf at any given time, the remaining outputs being in a high-impedance "floating" state. A monostable circuit 61 is arranged to provide a reset pulse to the counter 60 when the thyristor $Q_1$ (FIG. 7) turns on. Six of the outputs of the counter 60 provide power to the six columns of hall-effect devices, one column at a time. The outputs of the six hall-effect devices in each column form a 12-bit digital word. The same six outputs of the counter 60 supply signals to the end connector 57' of the matrix connection device 54, so that for each output one end of a different twelve strips in the board 55' are energised. The contacts of the other connector 56' are interconnected in adjacent groups of six, so as to provide a 12-bit digital output dependent on the pattern of holes in the board 55'. These two 12-bit digital words are applied to the two data word inputs of a 12-bit digital comparator circuit 62, the A=B output of which is connected to the trigger input of a monostable circuit 63 the output of which is connected to the CLOCK input of the counter 60.

Thus when the thyristor $Q_1$ turns on the counter 60 is reset and provides an output at its $J_1$ output terminal, thereby energising one column of hall-effect devices and the corresponding twelve strips of the board 55'. If the resulting two 12-bit words are equal, the counter 60 is clocked and the $J_2$ output goes high. Thus the "key code" is compared line-by-line with the code held on board 55' with the counter 60 being clocked each time the two words are equal. In the event of any pair of words failing to coincide the cycle stops. After all six stages output $J_7$ of the counter goes high and this fires the thyristor $Q_3$ to unlock the door.

It will be noted that the above described arrangement permits "three-level" logic without any additional components being necessary. Where there is to be no magnet at any specific array position on the key card, both associated strips on the board 55' are drilled through, whereas only one or the other is drilled through if a magnet is to be present.

In mass production the preparation and storage of the boards 55'and corresponding keys can easily be controlled, the board 55' being inserted as a last stage of production and one or more key cards being inserted with the lock on packaging. The keys could be produced first and used to programme an automatic machine for drilling the boards 55' or vice versa.

The invention may also be applied to more sophisticated lock systems utilizing non-volatile memories for storing the acceptable key code or codes for each lock, such memories being electronically re-programmable to change these codes whenever required.

We claim:

1. An electronic lock for a door comprising the combination of an operating member for displacing a locking element, an electronic circuit controlling the operation of the lock, said circuit being in a lock-operating condition only upon being electrically energised and upon receiving predetermined information supplied thereto by an authorized lock user, and electrical generator means mechanically connected to the operating member so as to generate electrical power for the lock and its electronic circuit when the operating member is moved, the generator means comprising resilient means drivingly connected to the operating member so as to store mechanical energy during initial movement of the operating member, release means operable by the operating member to release said resilient means and connecting means connecting the resilient means to an electrical generator so that said resilient means, when released, drives the generator.

2. An electronic lock as claimed in claim 1 in which said connecting means incorporates a one-way drive device whereby driving of the electrical generator during said initial movement of the operating member is prevented.

3. An electronic lock as claimed in claim 2 in which the electrical generator comprises a permanent magnet alternator.

4. An electronic lock as claimed in claim 3, further comprising a rectifier having its input connected to the alternator output and a storage capacitor connected to the output of the rectifier.

5. An electronic lock as claimed in claim 4, in which said electrically operated means comprises a lock release solenoid connected in series with a semi-conductor switch device across said storage capacitor.

6. An electronic lock as claimed in claim 5, further comprising a switchable stabilised supply for said electronic circuit, said supply being connected to draw current from said storage capacitor and being controlled by said semi-conductor switch device so as to cease drawing current when said semi-conductor switch device turns on.

7. An electronic lock as claimed in claim 6 in which said semi-conductor switch device is a thyristor.

8. An electronic lock as claimed in claim 1 in which said locking element comprises a bolt, and the lock includes electrically operable means for enabling movement of the operating member to cause displacement of the bolt, said electronic circuit controlling said electrically operable means and being responsive to a coded signal derived from a key element, continuing movement of the operating member beyond a position at which said release means operates acting, when the specific coded signal or one of a small number of coded signals is received to withdraw said bolt.

9. An electronic lock as claimed in claim 8, in which said electronic circuit comprises key code reading means and key code storage means for storing the or each acceptable code.

10. An electronic lock as claimed in claim 9 in which said key-code reading means comprises an array of integrated hall-effect devices, the associated key incorporating an array of correspondingly disposed magnets.

11. An electronic lock as claimed in claim 10, in which said key code storage means comprises a connection matrix connecting the outputs of said hall-effect devices to a gate circuit, whereby the gate circuit is activated only if the connections in the connection matrix match the outputs of the hall-effect devices.

12. An electronic lock as claimed in claim 9 including comparator means connected to compare an output digital word from the key-code reading means with an output digital word from said storage means.

13. An electronic lock as claimed in claim 12, in which said comparator means includes multiplexing means whereby a plurality of words from different groups of reading elements in the key code reading means are compared successively with a plurality of words from corresponding different portions of said storage means.

* * * * *